US010786020B2

(12) United States Patent
Harris et al.

(10) Patent No.: US 10,786,020 B2
(45) Date of Patent: Sep. 29, 2020

(54) METHOD AND SYSTEM FOR PLACING PRE-CUT NOSE WIRES IN A FACEMASK MANUFACTURING PROCESS

(71) Applicant: O&M Halyard, Inc., Mechanicsville, VA (US)

(72) Inventors: Nathan Craig Harris, Canton, GA (US); Joseph P. Weber, Suwanee, GA (US); Ajay Y. Houde, Johns Creek, GA (US); David Lamar Harrington, Cumming, GA (US); Mark Thomas Pamperin, Cumming, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 218 days.

(21) Appl. No.: 15/768,149

(22) PCT Filed: Oct. 16, 2015

(86) PCT No.: PCT/US2015/055872

§ 371 (c)(1),
(2) Date: Apr. 13, 2018

(87) PCT Pub. No.: WO2017/065791

PCT Pub. Date: Apr. 20, 2017

(65) Prior Publication Data

US 2018/0295906 A1 Oct. 18, 2018

(51) Int. Cl.
*A41D 13/11* (2006.01)

(52) U.S. Cl.
CPC ..... *A41D 13/11* (2013.01)

(58) Field of Classification Search
CPC ..... A41D 13/11–1192; A62B 23/025
See application file for complete search history.

(56) References Cited

U.S. PATENT DOCUMENTS 2,354,294 A 7/1944 Schimmel
3,123,125 A 3/1964 Lacey, Jr.
3,242,783 A 3/1966 Schmermund
(Continued)

FOREIGN PATENT DOCUMENTS

CA 828007 A 11/1969
CA 2 325 975 A1 5/2002
(Continued)

OTHER PUBLICATIONS

Machine translation of CN 104939377 A (Tamagawa Eizai Co LTD, Sep. 30, 2015).*
(Continued)

*Primary Examiner* — Joseph D. Boecker
(74) *Attorney, Agent, or Firm* — Dority & Manning, P.A.

(57) ABSTRACT

A method and system are provided for placing nose wires in a facemask production line. A supply of individual pre-cut nose wires are supplied to a dispenser in the production line. With the dispenser, the nose wires are metered at a defined spacing and orientation onto a running carrier web that is conveyed past the dispenser. The carrier web and nose wires deposited thereon are conveyed to a folding station wherein a binder web is folded over an edge of the carrier web such that the nose wires are encapsulated between the binder web and the carrier web.

9 Claims, 4 Drawing Sheets

(56) References Cited

U.S. PATENT DOCUMENTS

| | | | | |
|---|---|---|---|---|
| 3,670,474 | A | 6/1972 | Vieson et al. | |
| 3,800,640 | A | 4/1974 | Barrie | |
| 3,847,046 | A | 11/1974 | Schmermund | |
| 3,926,097 | A | 12/1975 | Santa Maria et al. | |
| 3,958,390 | A | 5/1976 | Pringle, Jr. et al. | |
| 3,971,369 | A | 7/1976 | Aspelin et al. | |
| 3,983,774 | A | 10/1976 | Seragnoli | |
| 4,261,457 | A | 4/1981 | van Maanen | |
| 4,269,315 | A | 5/1981 | Boyce | |
| 4,440,289 | A | 4/1984 | Wcis | |
| 4,467,589 | A | 8/1984 | van Maanen | |
| 4,525,977 | A | 7/1985 | Matt | |
| 4,543,152 | A | 9/1985 | Nozaka | |
| 4,549,386 | A | 10/1985 | Wilson | |
| 4,550,856 | A | 11/1985 | Ballmann et al. | |
| 4,630,310 | A | 12/1986 | Winesett | |
| 4,662,005 | A * | 5/1987 | Grier-Idris | A41D 13/1115 2/9 |
| 4,722,168 | A | 2/1988 | Heaney | |
| 4,809,481 | A | 3/1989 | Früh et al. | |
| 5,079,902 | A | 1/1992 | Seko et al. | |
| 5,117,614 | A | 6/1992 | Johnsen | |
| 5,155,967 | A | 10/1992 | Branson | |
| 5,170,610 | A | 12/1992 | Tisma | |
| 5,322,061 | A * | 6/1994 | Brunson | A41D 13/1115 128/206.13 |
| 5,548,946 | A | 8/1996 | Holub | |
| 5,615,767 | A | 4/1997 | Eull et al. | |
| 5,724,677 | A | 3/1998 | Bryant et al. | |
| 5,727,369 | A | 3/1998 | Mosse | |
| 5,921,375 | A | 7/1999 | Van Laar | |
| 6,098,785 | A | 8/2000 | Van Maanen | |
| 6,117,515 | A * | 9/2000 | Brunson | A41D 13/1115 428/83 |
| 6,122,898 | A | 9/2000 | De Kort | |
| 6,123,077 | A | 9/2000 | Bostock et al. | |
| 6,125,849 | A * | 10/2000 | Williams | A62B 23/025 128/206.12 |
| 6,173,712 | B1 | 1/2001 | Brunson | |
| 6,174,397 | B1 | 1/2001 | Johnson | |
| 6,394,090 | B1 | 5/2002 | Chen et al. | |
| 6,524,423 | B1 | 2/2003 | Hilt et al. | |
| 6,729,103 | B1 | 5/2004 | Hartness et al. | |
| 6,868,984 | B2 | 3/2005 | Griesbach, III et al. | |
| 6,886,563 | B2 | 5/2005 | Bostock et al. | |
| 7,703,260 | B1 | 4/2010 | Watkins | |
| 8,061,356 | B2 | 11/2011 | Bowen | |
| 8,700,214 | B2 | 4/2014 | Fortman | |
| 10,227,202 | B2 | 3/2019 | Pamperin et al. | |
| 10,492,547 | B2 | 12/2019 | Weber et al. | |
| 2002/0095913 | A1 | 7/2002 | Honegger | |
| 2003/0000805 | A1 | 1/2003 | Wild et al. | |
| 2003/0010422 | A1 | 1/2003 | Starkey | |
| 2004/0121107 | A1 | 6/2004 | Bell et al. | |
| 2004/0144619 | A1 | 7/2004 | Ohiro et al. | |
| 2004/0262127 | A1 | 12/2004 | Harnish et al. | |
| 2005/0166733 | A1 | 8/2005 | Piscitello | |
| 2006/0070353 | A1 | 4/2006 | Van Dam | |
| 2008/0072721 | A1 | 3/2008 | Kern | |
| 2008/0251210 | A1 | 10/2008 | Chen | |

FOREIGN PATENT DOCUMENTS

| | | | |
|---|---|---|---|
| CN | 104872866 | A | 9/2015 |
| CN | 104939377 | A | 9/2015 |
| DE | 3736868 | A1 | 5/1989 |
| EP | 0 257 852 | A2 | 3/1988 |
| EP | 0 622 298 | A1 | 11/1994 |
| EP | 0 640 526 | A1 | 3/1995 |
| EP | 0 791 537 | A1 | 8/1997 |
| EP | 0 806 343 | A2 | 11/1997 |
| EP | 0 894 752 | A1 | 2/1999 |
| EP | 1 048 595 | A1 | 11/2000 |
| EP | 1 757 552 | A2 | 2/2007 |
| EP | 1 840 033 | A2 | 10/2007 |
| EP | 2 484 611 | A2 | 8/2012 |
| EP | 2 757 062 | A1 | 7/2014 |
| EP | 2 801 790 | A1 | 11/2014 |
| FR | 1.588.621 | | 4/1970 |
| GB | 364557 | | 12/1931 |
| GB | 1 216 310 | | 12/1970 |
| GB | 1 232 053 | | 5/1971 |
| GB | 1 361 496 | | 7/1974 |
| GB | 2 092 090 | A | 8/1982 |
| JP | S 62103536 | U | 7/1987 |
| JP | H04311405 | A | 11/1992 |
| JP | H05-78007 | A | 3/1993 |
| JP | H05170209 | A | 7/1993 |
| JP | H06211214 | A | 8/1994 |
| JP | 2000198600 | A | 7/2000 |
| JP | 2002052487 | A | 2/2002 |
| JP | 2005272512 | A | 10/2005 |
| JP | 2007084309 | A | 4/2007 |
| JP | 2008055035 | A | 3/2008 |
| JP | 2009286490 | A | 12/2009 |
| JP | 2011178459 | A | 9/2011 |
| JP | 2011200510 | A | 10/2011 |
| JP | 2012201409 | A | 10/2012 |
| JP | 2013230380 | A | 11/2013 |
| KR | 100550225 | B1 | 2/2006 |
| WO | WO 97/32494 | | 9/1997 |
| WO | WO 99/24119 | A1 | 5/1999 |
| WO | WO 02/28760 | A1 | 4/2002 |
| WO | WO 2005/054106 | A1 | 6/2005 |

OTHER PUBLICATIONS

International Search Report and Written Opinion for PCT/US2015/055872, dated Jun. 2, 2016, 11 pages.

* cited by examiner

-Prior Art-

-Prior Art-

-Prior Art-

METHOD AND SYSTEM FOR PLACING PRE-CUT NOSE WIRES IN A FACEMASK MANUFACTURING PROCESS

FIELD OF THE INVENTION

The present invention relates generally to the field of protective facemasks, and more specifically to a method and system for placing nose wires in the manufacturing of such facemasks.

FAMILY OF RELATED APPLICATIONS

The present application is related by subject matter to the following concurrently filed PCT applications (all of which designate the US):

a. International Application No.: PCT/US2015/055858; entitled "Method and System for Splicing Nose Wire in a Facemask Manufacturing Process".

b. International Application No.: PCT/US2015/055861; entitled "Method and System for Splicing Nose Wire in a Facemask Manufacturing Process".

c. International Application No.: PCT/US2015/055863; entitled "Method and System for Introducing a Reserve Nose Wire in a Facemask Production Line".

d. International Application No.: PCT/US2015/055865; entitled "Method and System for Cutting and Placing Nose Wires in a Facemask Manufacturing Process".

e. International Application No.: PCT/US2015/055867; entitled "Method and System for Placing Nose Wires in a Facemask Manufacturing Process".

f. International Application No.: PCT/US2015/055871; entitled "Method and System for Placing Nose Wires in a Facemask Manufacturing Process".

g. International Application No.: PCT/US2015/055876; entitled "Method and System for Wrapping and Preparing Facemasks for Packaging in a Facemask Manufacturing Line".

h. International Application No.: PCT/US2015/055878; entitled "Method and System for Automated Stacking and Loading Wrapped Facemasks into a Carton in a Facemask Manufacturing Line".

i. International Application No.: PCT/US2015/055882; entitled "Method and System for Automated Stacking and Loading of Wrapped Facemasks into a Carton in a Facemask Manufacturing Line".

The above cited applications are incorporated herein by reference for all purposes. Any combination of the features and aspects of the subject matter described in the cited applications may be combined with embodiments of the present application to yield still further embodiments of the present invention.

BACKGROUND OF THE INVENTION

Various configurations of disposable filtering facemasks or respirators are known and may be referred to by various names, including "facemasks", "respirators", "filtering face respirators", and so forth. For purposes of this disclosure, such devices are referred to generically as "facemasks."

The ability to supply aid workers, rescue personnel, and the general populace with protective facemasks during times of natural disasters or other catastrophic events is crucial. For example, in the event of a pandemic, the use of facemasks that offer filtered breathing is a key aspect of the response and recovery to such event. For this reason, governments and other municipalities generally maintain a ready stockpile of the facemasks for immediate emergency use. However, the facemasks have a defined shelf life, and the stockpile must be continuously monitored for expiration and replenishing. This is an extremely expensive undertaking.

Recently, investigation has been initiated into whether or not it would be feasible to mass produce facemasks on an "as needed" basis during pandemics or other disasters instead of relying on stockpiles. For example, in 2013, the Biomedical Advanced Research and Development Authority (BARDA) within the Office of the Assistant Secretary for Preparedness and Response in the U.S. Department of Health and Human Services estimated that up to 100 million facemasks would be needed during a pandemic situation in the U.S., and proposed research into whether this demand could be met by mass production of from 1.5 to 2 million facemasks per day to avoid stockpiling. This translates to about 1,500 masks/minute. Current facemask production lines are capable of producing only about 100 masks/minute due to technology and equipment restraints, which falls far short of the estimated goal. Accordingly, advancements in the manufacturing and production processes will be needed if the goal of "on demand" facemasks during a pandemic is to become a reality.

The various configurations of filtration facemasks include a flexible, malleable metal piece, known as "nose wire", along the edge of the upper filtration panel to help conform the facemask to the user's nose and retain the facemask in place during use, as is well known. The nose wire may have a varying length and width between different sizes and mask configurations, but is generally cut from a spool in a continuous in-line process and laid onto a running carrier nonwoven web (which may include a plurality of nonwoven layers) along an edge that becomes a top edge of the finished mask. The edge is subsequently sealed with a binder material, which also encapsulates and permanently holds the nose wire in place at the top edge.

The process steps of conveying the supply of continuous wire, cutting the wire into individual nose wires, and placing the nose wires from the cutter takes time and specialized equipment. In addition, the splicing of a reserve wire onto the continuously running wire generally requires a stoppage of the production line. For mass production of facemasks in an in-line manufacturing process at the throughputs mentioned above, it would be desirable to eliminate the cutting step altogether, as well as the necessity to splice a reserve wire when the running wire is depleted.

The present invention addresses this need and provides a method and associated system for high speed cutting and placement of nose wires on the running carrier web in an in-line manufacturing process of facemasks.

SUMMARY OF THE INVENTION

Objects and advantages of the invention will be set forth in the following description, or may be obvious from the description, or may be learned through practice of the invention.

In accordance with aspects of the invention, a method is provided for placing nose wires in a facemask production line. The nose wires are pre-cut into a desired length and are supplied to a dispenser in the production line. With the dispenser, the nose wires are metered and deposited onto a running carrier web that is conveyed past the dispenser at a defined spacing and orientation. For example, the individual nose wires may be deposited along an edge of the carrier web that corresponds to the edge of an upper panel of the finished facemasks. The carrier web with nose wires deposited thereon are then conveyed to a folding station wherein a binder web is folded over an edge of the carrier web such that the nose wires are encapsulated between the binder web and the carrier web.

In a particular embodiment, the pre-cut nose wires are supplied in loose, unattached form to a hopper or accumulator that is operationally configured with the dispenser. The hopper may include any manner of mechanical means therein to orient the nose wires, which may then drop through a chute or other guide to the dispenser.

The dispenser may be variously configured for the purpose of isolating a single nose wire from the supply of nose wires and then depositing the single nose wire in a rotary or linear manner onto the carrier web. The present inventive method is not limited to any particular type of dispenser or dispensing method.

In an alternate embodiment, the pre-cut nose wires may be aligned for dispensing in a cartridge or other package that mates with the dispenser. The cartridge may include an internal biasing device, such as spring, that moves the nose wires towards the dispenser as the nose wires are depleted. Alternatively, the dispenser may have a rack or tray in which the cartridge is loaded, wherein the rack or tray has a biasing mechanism to advance the nose wires.

In still another embodiment, the pre-cut nose wires are supplied in a strip form, and are aligned and attached along longitudinal edges in the strip form, for example with an adhesive. For example, the nose wires may be configured similarly to strips of individual staples that are supplied to a staple gun, wherein the dispenser functions like the head of the staple gun with a punch that separates the leading nose wire from the strip for each dispense cycle and deposits the nose wire onto the underlying carrier web.

In may be preferred in certain embodiments that an adhesive is pre-applied to a surface of the nose wires that contacts the carrier web. This adhesive has sufficient tack to ensure that the nose wires remain attached to the carrier web at the desired spacing and orientation.

The present invention also encompasses various system embodiments for for placing pre-cut nose wires in a facemask production line in accordance with the present methods, as described and supported herein.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

As mentioned, the present methods relates to cutting and placement of individual nose wires in a facemask production line. The downstream facemask production steps are not limiting aspects of the invention and, thus, will not be explained in great detail herein.

Also, the present disclosure refers to or implies conveyance or transport of certain components of the facemasks through the production line. It should be readily appreciated that any manner and combination of article conveyors (e.g., rotary and linear conveyors), article placers (e.g. vacuum puck placers), and transfer devices are well known in the article conveying industry and can be used for the purposes described herein. It is not necessary for an understanding and appreciation of the present methods to provide a detailed explanation of these well-known devices and system.

Various styles and configurations of facemasks that incorporate a nose wire are well known, including flat pleated facemasks, and the present methods may have utility in the production lines for these conventional masks. For illustrative purposes only, aspects of the present method are described herein with reference to a particular type of respirator facemask often referred to in the art as a "duckbill" mask, as illustrated in FIG. 1.

Figure 1:
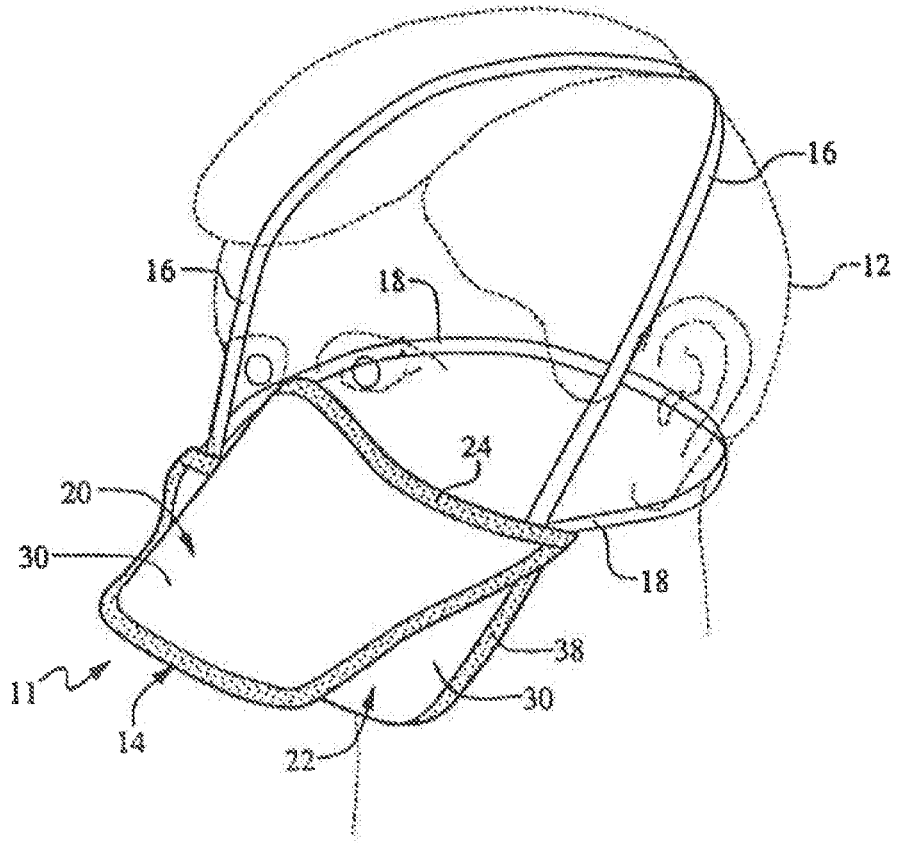
FIG. 1 is a perspective view of a conventional respiratory facemask worn by a user, the facemask incorporating a nose wire to conform the facemask to the user's face.
Figure 2:
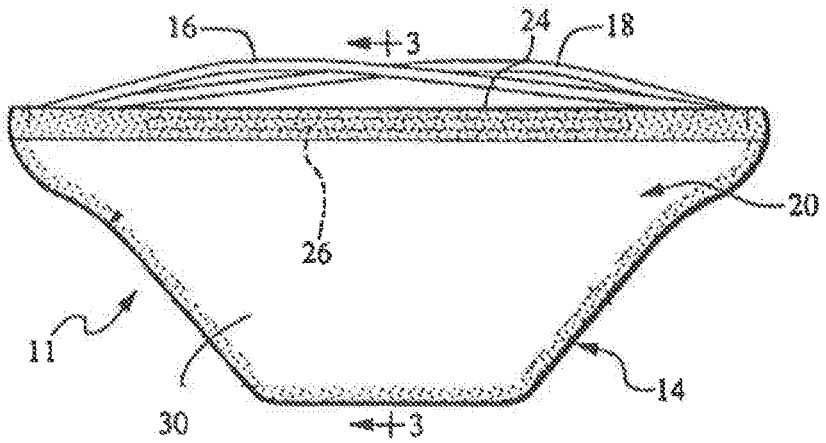
FIG. 2 is a top view of the conventional facemask of FIG. 1 is a folded state.
Figure 3:
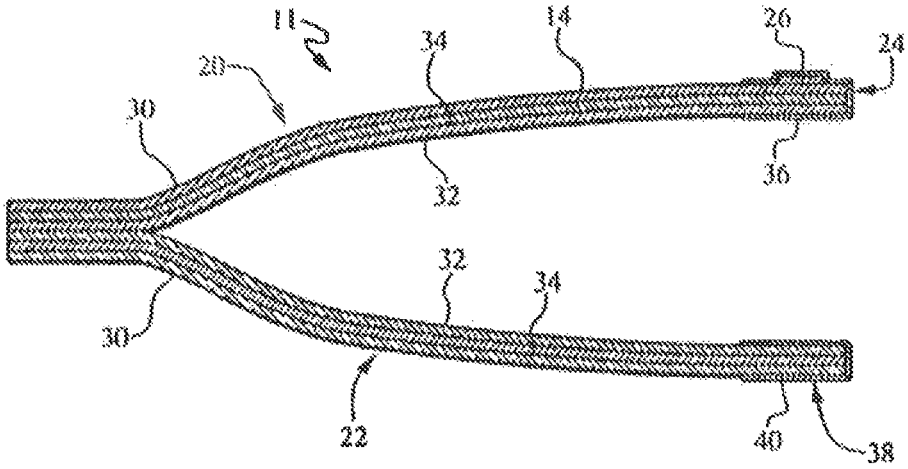
FIG. 3 is a cross-sectional view of the facemask of FIG. 2 taken along the lines indicated in FIG. 2.

Referring to FIGS. 1-3, a representative facemask 11 (e.g., a "duckbill" facemask) is illustrated on the face of wearer 12. The mask 11 includes filter body 14 that is secured to the wearer 12 by means of resilient and elastic straps or securing members 16 and 18. The filter body 14 includes an upper portion 20 and a lower portion 22, both of which have complimentary trapezoidal shapes and are preferably bonded together such as by heat and/or ultrasonic sealing along three sides. Bonding in this manner adds important structural integrity to mask 11.

The fourth side of the mask 11 is open and includes a top edge 24 and a bottom edge 38, which cooperate with each other to define the periphery of the mask 11 that contacts the wearer's face. The top edge 24 is arranged to receive an elongated malleable member 26 (FIGS. 2 and 3) in the form of a flat metal ribbon or wire (referred to herein as a "nose wire"). The nose wire 26 is provided so that top edge 24 of mask 11 can be configured to closely fit the contours of the nose and cheeks of wearer 12. The nose wire 26 is typically constructed from an aluminum strip with a rectangular cross-section. With the exception of having the nose wire 26 located along top edge 24 of the upper portion 20 of the mask 11, the upper and lower portions 20 and 22 may be identical.

As shown in FIG. 1, the duckbill mask 11 has the general shape of a cup or cone when placed on the face of wearer 12 and thus provides "off-the-face" benefits of a molded-cone style mask while still being easy for wearer 12 to carry mask 11 in a pocket prior to use. "Off-the-face" style masks provide a larger breathing chamber as compared to soft, pleated masks which contact a substantial portion of the wearer's face. Therefore, "off-the-face" masks permit cooler and easier breathing.

Blow-by associated with normal breathing of wearer 12 is substantially eliminated by properly selecting the dimension and location of the nose wire 26 with respect to top edge of 24. The nose wire 26 is preferably positioned in the center of top edge 24 and has a length in the range of fifty percent (50%) to seventy percent (70%) of the total length of the top edge 24.

As illustrated in cross-sectional view of FIG. 3, the upper and lower portions 20 and 22 may include multiple layers and each have an outer mask layer 30 and inner mask layer 32. Located between outer and inner mask layers 30, 32 is one or more intermediate layer 34 that comprises the filter media for the mask 11. This layer is typically constructed from a melt-blown polypropylene, extruded polycarbonate, melt-blown polyester, or a melt-blown urethane.

The top edge 24 of the mask 11 is faced with an edge binder 36 that extends across the open end of mask 11 and covers the nose wire 26. Similarly, the bottom edge 38 is encompassed by an edge binder 40. Edge binders 36 and 40 are folded over and bonded to the respective edges 24, 30 after placement of the nose wire 26 along the top edge 24. The edge binders 36, 40 may be constructed from a spun-laced polyester material.

Figure 4:
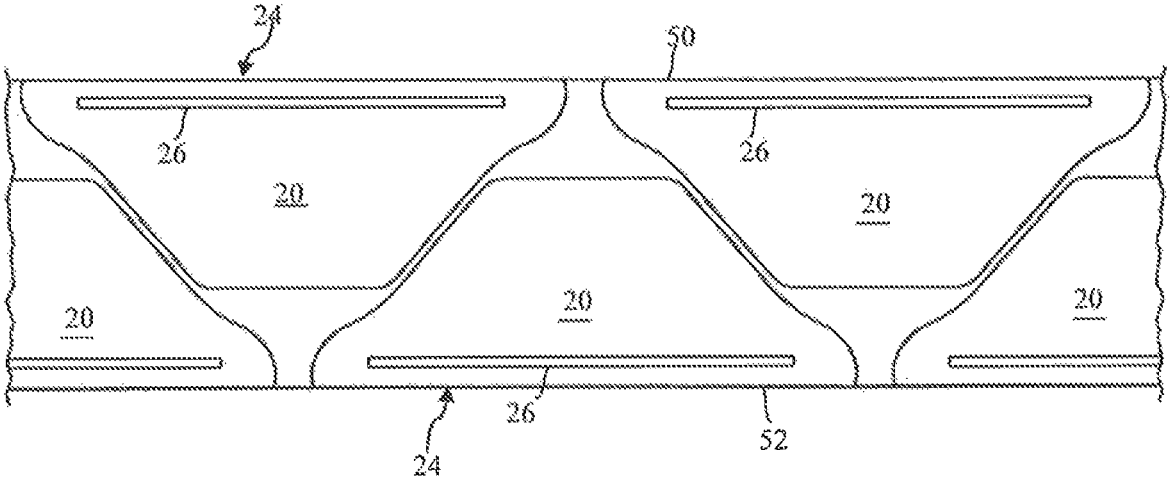
FIG. 4 is a top view of a web having a plurality of facemask panels defined therein, with a nose wire incorporated in edges of alternating panels in the web.

FIG. 4 illustrates the layout of the generally trapezoidal shape for cutting the layers forming the upper body portions 20. A similar layout would be produced for the lower body portion 22, which is then brought into alignment with and bonded to the upper body portion 20 in the facemask manufacturing line. More precisely, the layouts of FIG. 4 represent the outline of cutters which ultimately cut layers 30 and 32 for the upper portion 20 from respective flat sheets of material, with the layouts arranged in an alternating pattern on the flat sheets of material between edges 50, 52 representing the open side of mask 11 formed by top edge 24 and bottom edge 38. The arrangement of the layouts is such that a continuous piece of scrap may be formed as the material is fed through the cutter (not shown) utilized in making mask 11. FIG. 4 illustrates placement of cut nose wires 26 on the portions of the continuous web corresponding to the top edge 24 prior to folding and bonding of the edge binders 36, 40 along the edges 24, 38.

Figure 5:
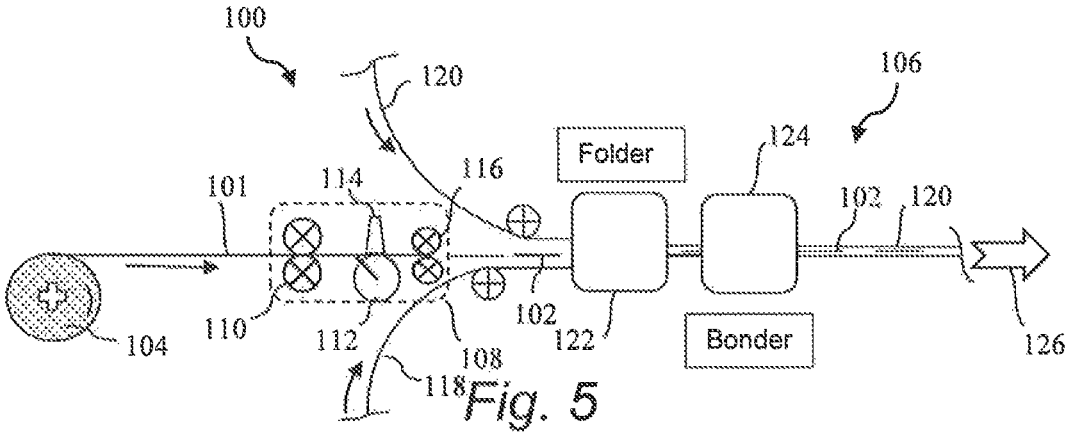
FIG. 5 is a schematic depiction of a facemask production line related to cutting and placement of nose wires on a web.

FIG. 5 depicts portions of a production line 106 for facemasks that incorporate a nose wire 26 (FIG. 4). A running wire 101 is supplied in continuous strip form from a source, such as a driven roll 104, to a cutting station 108. Suitable cutting stations 108 are known and used in conventional production lines. The station 108 typically includes a set of feed rollers 110 that define a driven nip, wherein one of the feed rollers is driven and the other may be an idler roll. The running wire 101 is fed to a cutter roller 112 configured opposite to an anvil 114 (which may be a stationary or rotary anvil), wherein the cuter roller 112 is driven at a rate so as to cut the running wire 101 into individual nose wires 102 having a defined length. Downstream of the cutter roller 112, a pair of delivery rollers 116 transports the individual nose wires 102 from the cutting station 108 onto a carrier web 118. Referring to FIG. 4, this carrier web 118 may be the continuous multi-layer web that defines the upper body portion 20 wherein the individual nose wires 26 are deposited along the edge of the carrier web 118 corresponding to the top edge 24.

After placement of the individual nose wires 102 in position on the carrier web 118, the binder web 120 is introduced to the production line along both edges of the carrier web 118 (only one binder web 120 is depicted in FIG. 5.). The combination of carrier web 118, nose wire 26, and binder webs 120 pass through a folding station 122 wherein the binder webs 118 are folded around the respective running edges 50, 52 of the carrier web 118 (FIG. 4). The components then pass through a bonding station 124 wherein the binder webs 120 are thermally bonded to the carrier web 118, thereby producing the edge configurations 24, 38 depicted in FIG. 3 with respective binders 36, 40. The nose wire 26 is held in position relative to the top edge 24 by the binder 36.

From the bonding station 124, the continuous combination of carrier web 118 with nose wires 26 under the binder 36 is conveyed to further downstream processing stations 126 wherein the individual facemasks are cut, bonded, head straps are applied, and so forth.

Figure 6:
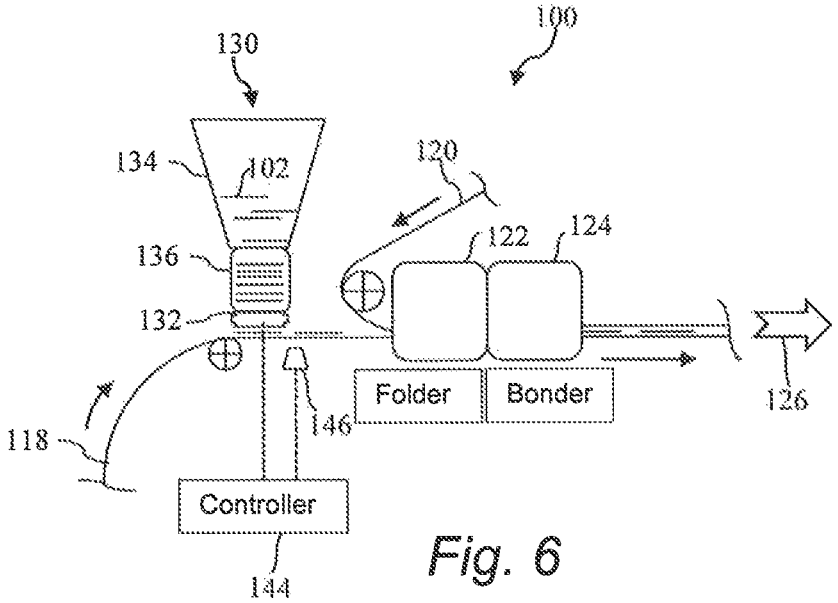
FIG. 6 is a schematic representation of an embodiment for placement of individual, pre-cut nose wires on a carrier in accordance with aspects of the invention.
Figure 7:
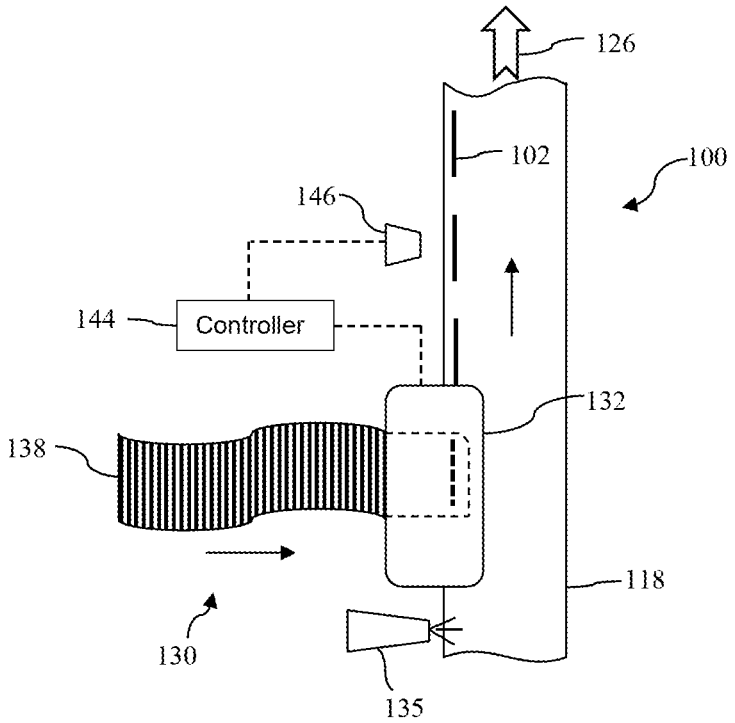
FIG. 7 is a schematic representation of another embodiment for placement of individual, pre-cut nose wires on a carrier web in accordance with aspects of the invention.
Figure 8:
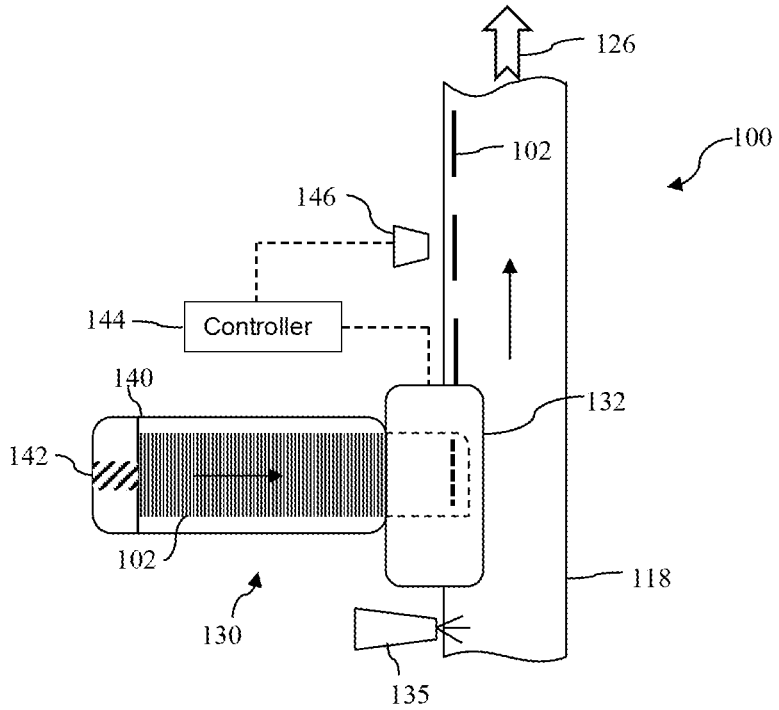
FIG. 8 is a schematic representation of yet a different embodiment for placement of individual, pre-cut nose wires on a carrier web in accordance with aspects of the invention.

Referring to FIGS. 6 through 8, as mentioned, an objective of the present method is to eliminate the cutting station 108 from the production line 106. In this regard, a method 100 is provided wherein the nose wires 102 are pre-cut into a desired length and are supplied in this form to a dispenser 132 in the production line. With this dispenser 132, the nose wires 102 are metered and deposited at a defined spacing and orientation onto the running carrier web 118 that is conveyed past the dispenser 132. For example, the individual nose wires 102 may be deposited along an edge of the carrier web 118 that corresponds to the edge 24 of an upper panel 20 of the finished facemasks. It should be appreciated that an additional dispenser 132 may be operationally disposed opposite to (and upstream or downstream) of the illustrated dispenser 132 in FIG. 6 for placing the nose wires on the opposite nested upper body portions 20 in the web depicted in FIG. 4. For the sake of ease of understanding only one such dispenser 132 is illustrated and described herein.

The particular type and operation of the dispenser 132 can vary within the scope and spirit of the invention. For example, the dispenser 132 may utilize a rotary wheel that receives an individual nose wire 102 within a slot at a first position, and rotates to a second position wherein the nose wire 102 falls from (or is ejected from) the slot onto the underlying web. In an alternate embodiment, the dispenser 132 may use a linear slide mechanism that engages an individual nose wire 102 and pushes the wire to a slot where the nose wire 102 falls (or is ejected) onto the carrier web 118. The present methods 100 are not limited to use of any particular dispenser.

Referring to FIG. 6, the pre-cut nose wires 102 may be supplied in loose, unattached form to a hopper or accumulator 134 that is operationally configured with the dispenser 132. A chute 136 may be an integral component of the hopper 134 or may be a separate component installed between the hopper 134 and dispenser 132. The hopper 134 and chute 136 may include any manner of mechanical means to orient the nose wires 102, which may then drop through a chute 136 (or other guide means) to the dispenser 132.

Once deposited by the dispenser 132 onto the carrier web 118, the nose wires 102 and web 118 are conveyed to the folding station 122 and combined with the binder web 120, as discussed above with reference to FIG. 5.

Referring to FIG. 7, in another embodiment of the method 100, the pre-cut nose wires 102 are supplied in a strip form 138. The wires 102 may be aligned and attached along longitudinal edges in the strip form 138, for example with an adhesive. With this arrangement, the nose wires 102 may be configured similar to strips of individual staples that are supplied to a conventional staple gun. The dispenser 132 functions like the head of a staple gun with a punch member that separates the leading nose wire 102 from the strip 138 for each dispense cycle and deposits the individual nose wire 102 onto the underlying carrier web 118.

In an alternate embodiment of the method 100 depicted in FIG. 8, the pre-cut nose wires 102 may be aligned for dispensing in a cartridge 140 or other package that mates with the dispenser 132. The nose wires 102 may be attached within the cartridge 140, for example with an adhesive, or may be loose within the cartridge 140. The cartridge 140 may include an internal biasing device, such as spring 142, that moves the nose wires 102 towards the dispenser 132 as the nose wires 102 are depleted. Alternatively, the dispenser 132 may have a rack or tray in which the cartridge is loaded, wherein the rack or tray has a biasing mechanism to advance the nose wires.

In may be desired that an adhesive is pre-applied to a surface of the nose wires 102 that contacts the carrier web 118. This adhesive should have sufficient tack to ensure that the nose wires 102 remain attached to the carrier web 118 at the desired spacing and orientation.

In an alternate embodiment depicted in FIGS. 7 and 8, an adhesive applicator 135 is used to apply an adhesive onto the surface of the carrier web 118 along the edge that will contain the nose wires 102 to further aid in holding the nose wires in the desired spacing and orientation on the web 118.

Referring to FIGS. 7 and 8, a controller 144 may be configured with the dispenser 132 to ensure that the dispenser 132 cycles at a rate needed to provide the proper spacing of nose wires 102 along the edge of the carrier web 118. A speed sensor 146 may be located adjacent to the carrier web 118 and in communication with the controller 144, wherein the cycle rate of the dispenser 132 is timed with actual speed of the carrier web 118.

As mentioned, the present invention also encompasses various system embodiments for placing precut nose wires onto a web in a facemask production line in accordance with the present methods. Aspects of such systems are illustrated in the figures, and described and supported above.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A method for placing nose wires in a facemask production line, comprising:

providing a supply of individual pre-cut nose wires to a dispenser in the production line; and with the dispenser, metering the nose wires at a defined spacing and orientation onto a running carrier web that is conveyed past the dispenser; and conveying the carrier web and nose wires deposited thereon to a folding station wherein a binder web is folded over an edge of the carrier web such that the nose wires are encapsulated between the binder web and the carrier web.

2. The method as in claim 1, wherein the pre-cut nose wires are supplied in loose, unattached form to a hopper operationally configured with the dispenser.

3. The method as in claim 1, wherein the pre-cut nose wires are carried in a cartridge that mates with the dispenser.

4. The method as in claim 1, wherein the pre-cut nose wires are supplied in a strip form, and wherein the nose wires are aligned and attached along longitudinal edges in the strip form.

5. The method as in claim 4, wherein the dispenser separates a leading nose wire from the strip form for each metering of the nose wires onto the carrier web.

6. The method as in claim 4, wherein the nose wires are attached by an adhesive along their longitudinal edges in the strip form.

7. The method as in claim 1, wherein the nose wires have an adhesive pre-applied to a surface thereof that contacts the carrier web.

8. The method as in claim 1, wherein the carrier web forms an upper panel portion of facemasks produced in the production line.

9. The method as in claim 1, further comprising applying an adhesive to the carrier web along an edge that will contain the nose wires prior to placing the nose wires onto the carrier web.

* * * * *